US005738207A

United States Patent [19]

Trimani

[11] Patent Number: 5,738,207

[45] **Date of Patent: *Apr. 14, 1998**

[54] RIGID HINGED-LID PACKET FOR ELONGATED ITEMS PARTICULARLY CIGARETTES

[75] Inventor: Carlo Trimani, Bologna, Italy

[73] Assignee: G.D. Societa' Per Azioni, Bologna, Italy

[ * ] Notice: The term of this patent shall not extend beyond the expiration date of Pat. No. 5,651,454.

[21] Appl. No.: 566,182

[22] Filed: Dec. 1, 1995

[30] Foreign Application Priority Data

Dec. 6, 1994 [IT] Italy ..... BO94A0538

[51] Int. Cl.[6] ..... B65D 85/10

[52] U.S. Cl. ..... 206/268; 206/273; 229/160.1

[58] Field of Search ..... 206/242, 256–258, 206/265, 268, 271, 273; 229/160.1, 125.37

[56] References Cited

U.S. PATENT DOCUMENTS

| | | | |
|---|---|---|---|
| 4,196,842 | 4/1980 | Focke et al. | 206/268 |
| 4,267,958 | 5/1981 | Focke et al. . | |
| 4,466,536 | 8/1984 | Zeitel | 206/273 |
| 4,729,508 | 3/1988 | Erdmann et al. | 206/268 |
| 5,203,495 | 4/1993 | Jorgensen-beck et al. | 206/273 |
| 5,379,889 | 1/1995 | Cobler | 206/268 |

FOREIGN PATENT DOCUMENTS

| | | |
|---|---|---|
| 0 007 410 A1 | 5/1979 | European Pat. Off. . |
| 1 492 492 | 5/1974 | United Kingdom . |
| 2 151 212 | 7/1985 | United Kingdom . |

*Primary Examiner*—Paul T. Sewell
*Assistant Examiner*—Luan. K. Bui
*Attorney, Agent, or Firm*—Marshall, O'Toole, Gerstein, Murray & Borun

[57] ABSTRACT

A rigid hinged-lid packet for elongated items, particularly cigarettes; the packet being formed by folding a flat blank defined by a number of panels aligned with one another and each presenting two lateral wings; a first and second panel defining the front wall of a collar and the front wall of the container of the packet, and being connected to each other by an appendix foldable inside the second panel; a third and fourth panel defining the rear wall of the container and the rear wall of the lid of the container and the rear wall of the lid of the container; each wing of the third panel and the corresponding wing of the fourth panel defining a recess engaged by a first portion of the corresponding wing of the first panel; and a second portion of each wing contacting the inner surface of the corresponding wing of the panel, and being gripped between the wing and the corresponding wing of the panel.

2 Claims, 2 Drawing Sheets

RIGID HINGED-LID PACKET FOR ELONGATED ITEMS PARTICULARLY CIGARETTES

BACKGROUND OF THE INVENTION

The present invention relates to a rigid hinged-lid packet for elongated items, particularly cigarettes.

In the following description, specific reference is made, purely by way of example, to a rigid hinged-lid packet for cigarettes.

In the tobacco industry, packing machines are used for wrapping preformed groups of cigarettes inside respective foil wrappings, and conditioning the groups inside respective rigid packets, each comprising a cup-shaped hollow bottom container or body, and a cup-shaped top lid hinged to a top edge of the container so as to rotate between two positions respectively opening and closing the container.

Known rigid packets generally comprise a continuous rear wall divided into two parts by a virtual transverse hinge connecting the lid to the container; a front wall defined by two separate portions respectively constituting the front wall of the container and the front wall of the lid; and two lateral walls, each defined by a rear wing projecting laterally from the rear wall, and a front wing superimposed on the first and projecting laterally from the front wall. Like the front wall, each lateral wall is also defined by two separate portions respectively constituting the lateral wall of the container and the lateral wall of the lid.

Known rigid packets of the above type often present a U-shaped collar partly inserted inside the container, contacting the inner surface of the front wall and lateral walls of the container, and projecting upwards from the top edge of the container to partly engage the lid and prevent it from being accidentally opened when in the closed position.

On known packing machines, each rigid packet is formed by feeding the respective preformed group of cigarettes—already enclosed in the foil wrapping—through a loading station where it is combined with a respective U-shaped collar to form an assembly which, together with a respective blank, is fed to the input station of a wrapping wheel along which each blank is folded about the respective group of cigarettes to form a respective rigid hinged-lid packet.

Known packing machines therefore normally present two synchronized supply lines: one for the blanks, and the other for the collars.

To simplify the structure of known packing machines of the above type, and more specifically to eliminate the collar supply line, British Patent n. 2,151,212, for example, employs a blank wherein a free longitudinal end of an end panel, corresponding to the front wall of the container, is connected to the collar via the interposition of a longitudinal appendix; the collar comprises a central panel integral with the appendix, and two wings projecting laterally from the central panel; and the appendix of the blank is folded on to the inner surface of the end panel to define the front wall of the container complete with the collar.

Though it does in fact provide for eliminating the separate collar supply line, the above blank presents serious drawbacks due to the difficulty encountered in folding it on most known packing machines. On known packing machines, in fact, each blank, as it is fed forward on the wrapping wheel, is normally folded about the respective group in a succession of steps, the last one of which normally comprises folding the front wings on to the respective rear wings to complete the lateral walls of the packet.

In the case of a blank with a built-in collar as described in British Patent n. 2,151,212, the above final step would require radical alterations to known packing machines for producing rigid hinged-lid packets.

SUMMARY OF THE INVENTION

It is an object of the present invention to provide a rigid hinged-lid packet produced from a blank with a built-in collar, and which may be produced using known packing machines of the above type with no alterations required.

According to the present invention, there is provided a rigid hinged-lid packet for elongated items, particularly cigarettes, the packet comprising a cup-shaped container open at one end; a cup-shaped lid hinged to the rear edge of and for closing said open end; and a collar inserted inside the container and projecting outwards of the container through said open end; the packet being formed by folding a flat blank comprising a number of panels presenting respective pairs of longitudinal edges, and a longitudinal wing located outwards of each longitudinal edge of each panel; a first and second of said panels, presenting respective pairs of respective first and second said wings, defining the front wall of the collar and the front wall of the container; a longitudinal appendix connecting the first and second panels, and being folded inside the second panel so that the first panel partly contacts the inner surface of the second panel; and a third and fourth of said panels, presenting respective pairs of respective third and fourth said wings, respectively defining the rear wall of the container and the rear wall of the lid, and being connected to each other by a hinge connecting said lid to said container; the packet being characterized in that each third wing and the corresponding fourth wing define a recess engaged by a first portion of the corresponding first wing; a second portion of each first wing being gripped between the corresponding second wing of said second panel and the corresponding third wing of said third panel.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
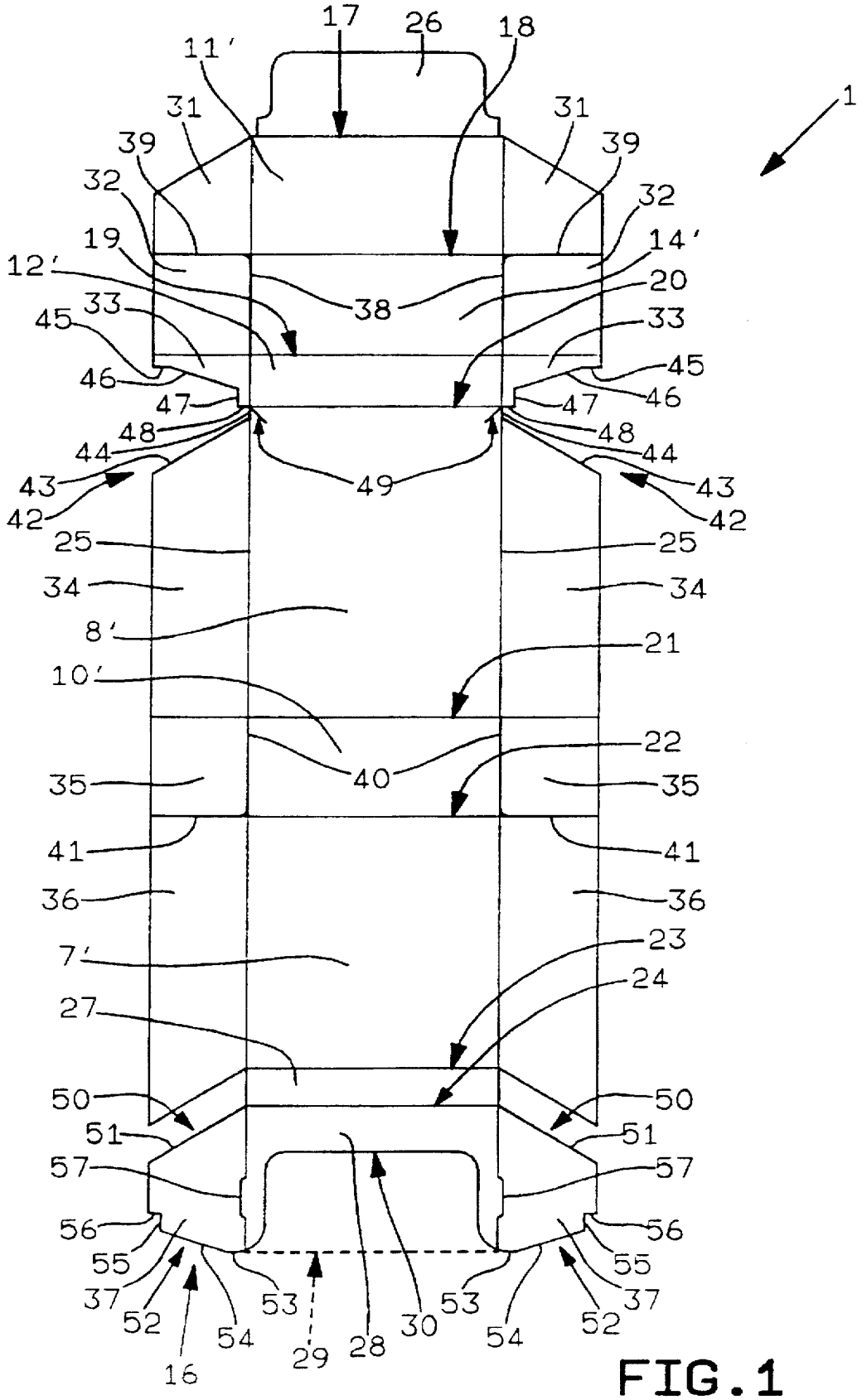
FIG. 1 shows a spreadout view of a preferred embodiment of a blank from which to form a packet in accordance with the present invention.

Number 1 in FIG. 1 indicates a flat, substantially rectangular blank from which to form a rigid packet 2 (FIG. 2) housing a group of cigarettes (not shown) enclosed in a foil wrapping 3, and comprising a cup-shaped bottom container 4 with an open top end 5, and a cup-shaped top lid 6 hinged to container 4 so as to rotate between two positions respectively closing and opening end 5.

Figure 2:
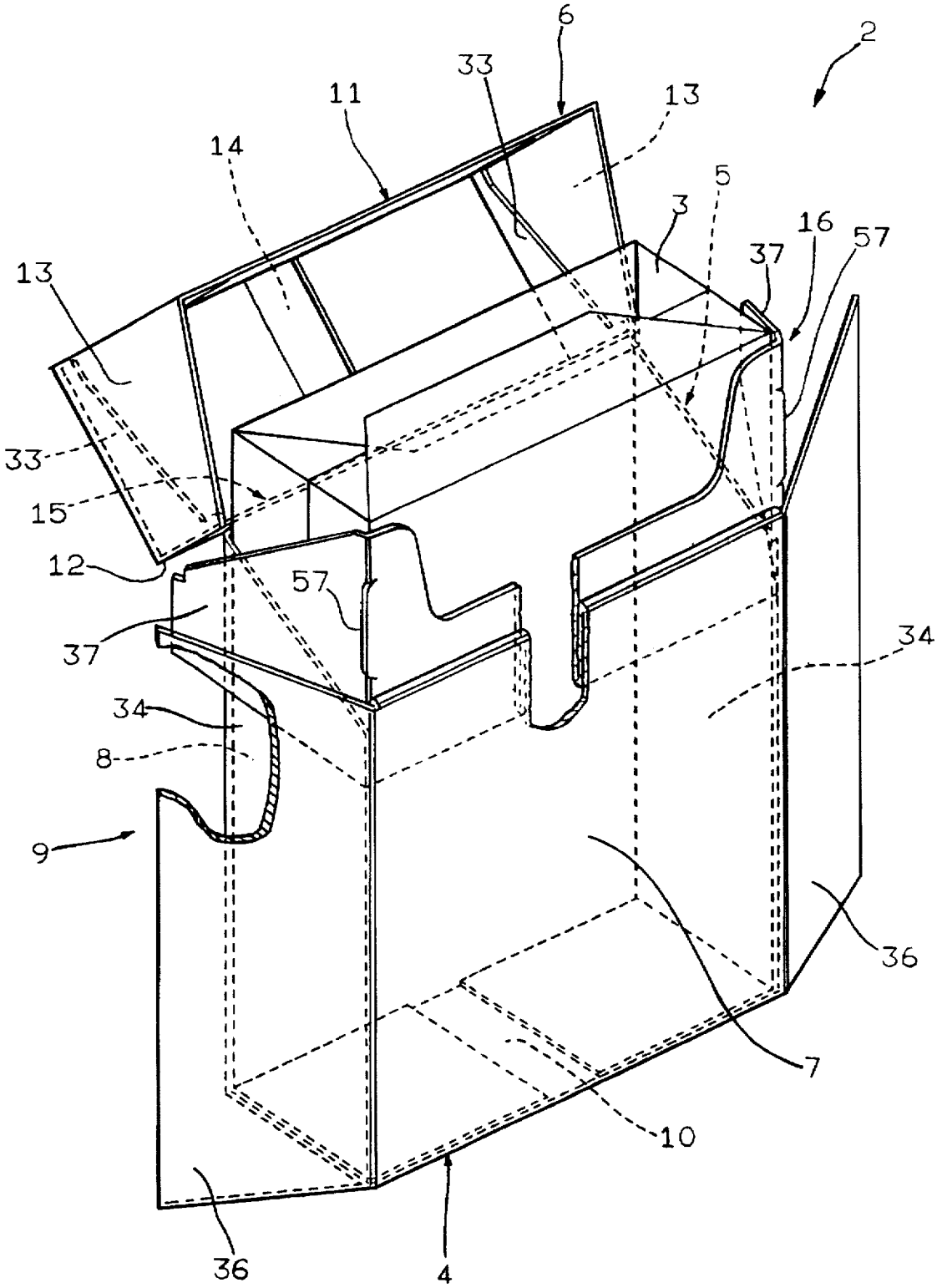
FIG. 2 shows a view in perspective, with parts removed for clarity, of the packet being formed from the FIG. 1 blank.

With reference to FIG. 2, container 4 presents a front wall 7 and a rear wall 8 facing and parallel to each other, two lateral walls 9 parallel to each other and perpendicular to walls 7 and 8, and a bottom wall 10 perpendicular to walls 7, 8 and 9; and lid 6 presents a front wall 11 and a rear wall 12 facing and parallel to each other, two lateral walls 13 parallel to each other and perpendicular to walls 11 and 12, and a top wall 14 perpendicular to walls 11, 12 and 13. More specifically, the free bottom edge of wall 12 is integral with the free top edge of wall 8 along a preformed bend line defining a hinge 15 about which lid 6 rotates between said open and closed positions.

As shown in FIG. 2, packet 2 also comprises a U-shaped collar 16 partly inserted through end 5 of container 4, and projecting outwards of container 4 to engage lid 6 and prevent it from being opened accidentally.

As shown in FIG. 1, blank 1 presents preformed longitudinal and transverse bend lines defining the walls and panels of packet 2.

For the sake of simplicity in the following description, the corresponding panels and walls of blank 1 and packet 2 will be indicated using the same reference numbers differentiated by a superscript for the panels and walls of blank 1.

As shown in FIG. 1, blank 1 presents a number of preformed transverse bend lines 17–24 and two preformed longitudinal bend lines 25 defining, on blank 1, a number of panels corresponding at least partly to the walls of container 4 and lid 6, and indicated, where possible, using the same reference numbers as the corresponding walls, plus a superscript.

Between lines 25, lines 17–24 define an end tab 26; an end panel 11' which is reinforced internally tab 26 when this is folded 180° about line 17; a first intermediate panel 14'; a second intermediate panel 12' shorter in height than panel 14'; a first central panel 8' connected to panel 12' along line 20 defining hinge 15; and a second central panel 7' separated from panel 8' by a third intermediate panel 10'.

At the opposite end to that connected to panel 10', panel 7' presents a longitudinal appendix 27 extending from a central portion of line 23 and connected, along line 24, to an end panel 28 extending between lines 25 and defined, on the opposite side to line 24, by a straight edge 29 parallel to line 24 and presenting a central recess 30.

With reference to FIG. 1, each line 25 defines tabs 31, 32, 33, 34, 35, 36 and 37 outwards of respective panels 11', 14', 12', 8', 10', 7' and 28, and each of tabs 32 outwards of panel 14' is detached from panel 14' and relative tab 31 by two cuts 38 and 39 extending respectively along lines 25 and 18, and is integral with relative tab 33 along line 19. Similarly, each tab 35 is integral with relative tab 34 along line 21, and is detached from panel 10' and relative tab 36 by two cuts 40 and 41 extending respectively along line 25 and 22.

As shown in FIG. 1, astride line 20 and between each tab 33 and relative tab 34, there is formed a recess 42 defined by an oblique outer edge 43 of tab 34, by a vertical edge 44 in turn defined by line 25, and by outer edges 45, 46, 47 and 48 of tab 33. More specifically, edge 45 is parallel to line 19, edge 46 is an oblique edge, edge 47 is parallel to line 25, and edge 48 is defined by line 20.

In addition to respective recess 42, each tab 33 is also separated from relative tab 34 by a cut 49 formed in panel 8'.

Each tab 37 presents a portion 50 (FIG. 1) defined by an oblique edge 51; and a portion 52 (FIG. 1) defined by an edge 53 in turn defined by line 29, by an oblique edge 54, and by two edges 55 and 56 perpendicular to each other and respectively parallel to lines 25 and 24. More specifically, edges 53, 54, 55 and 56 of each tab 37 are so formed that, when the packet is finished, they are respectively complementary to edges 45, 46, 47 and 48 of corresponding tab 33.

Blank 1 as described above is folded in a known sequence (not shown), which comprises the initial step of folding appendix 27 inside panel 7' so that the bottom portion of each tab 37 of collar 16 contacts the inner surface of respective tab 36, and simultaneously folding tab 26 inside panel 11'; and a final step wherein packet 2 is completed by folding tabs 31 and 36 squarely on to corresponding tabs 33 and 34.

When so folded, portion 50 of each tab 37 is therefore gripped between tab 36 and corresponding tab 34 which directly contacts a lateral wall of wrapping 3; and, at recess 42, each portion 52 of tab 37 contacts a respective lateral wall of wrapping 3, with edges 53–56 substantially contacting respective edges 45–48 of corresponding tab 33.

Blank 1 therefore provides, on the one hand, for using conventional wrapping wheels, and, on the other, for dispensing with the blank supply line, and so greatly simplifying the packing machines employed.

To improve the friction between lid 6 and collar 16, collar 16, as shown in FIGS. 1 and 2, presents two curved cuts 57 extending substantially along respective lines 25 and defining—in known manner, when tabs 37 are folded squarely in relation to panel 28—two tabs projecting outwards in relation to tabs 37.

I claim:

1. A rigid hinged-lid packet for elongated tobacco articles, the packet comprising a cup-shaped container open at one end, said open end having a rear edge; a cup-shaped lid hinged to said rear edge for closing said open end; and a collar inserted inside the container and projecting outwards of the container through said open end; the packet being formed by folding a flat blank comprising a number of panels having respective pairs of longitudinal edges, and a longitudinal wing located outwards of each longitudinal edge of each panel, said longitudinal wings having substantially a same width; a first and second of said panels, having respective pairs of respective first and second said wings, defining the front wall of the collar and the front wall of the container; a longitudinal appendix connecting the first and second panels, and being folded inside the second panel so that the first panel partly contacts the inner surface of the second panel; and a third and fourth of said panels, having respective pairs of respective third and fourth said wings, respectively defining the rear wall of the container and the rear wall of the lid, said rear walls being connected to each other by a hinge connecting said lid to said container; each fourth wing being coplanar with the corresponding first wing and partially defining a recess for receiving a first portion of the corresponding first wing; a second portion of each first wing being gripped between the corresponding second wing of said second panel and the corresponding third wing of said third panel.

2. A packet as claimed in claim 1, wherein each said recess is defined at the top by a number of outer edges of said fourth wing; said outer edges being complementary to and substantially contacting respective edges externally defining the first portion of the corresponding first wing.

* * * * *